US005890707A

United States Patent [19]

Allibert et al.

[11] Patent Number: 5,890,707

[45] Date of Patent: Apr. 6, 1999

[54] DOCUMENT GUIDING DEVICE FOR A FOLDING AND OR INSERTING MACHINE

[75] Inventors: Cédric Allibert, Le Kremlin Bicetre; Christophe Bezelga, Bagneux; Marek Krasuski, Fontenay Aux Roses, all of France

[73] Assignee: Neopost Industrie, Bagneux, France

[21] Appl. No.: 790,020

[22] Filed: Jan. 28, 1997

[30] Foreign Application Priority Data

Jan. 29, 1996 [FR] France ..... 96 00979

[51] Int. Cl.[6] ..... B65H 3/44; B65H 5/26

[52] U.S. Cl. ..... 271/9.09; 271/9.12; 271/9.13; 271/124

[58] Field of Search ..... 271/9.09, 9.11, 271/9.12, 9.13, 121, 124, 145

[56] References Cited

U.S. PATENT DOCUMENTS

| | | | |
|---|---|---|---|
| 5,183,526 | 2/1993 | Walter . | |
| 5,216,472 | 6/1993 | Muto et al. . | |
| 5,584,475 | 12/1996 | Asada et al. | 271/121 |

FOREIGN PATENT DOCUMENTS

| | | | |
|---|---|---|---|
| 0352692 A1 | 1/1990 | European Pat. Off. . | |
| 0661175 A1 | 7/1995 | European Pat. Off. . | |
| 2691703 A1 | 12/1993 | France . | |
| 40615678 A | 6/1994 | Japan | 271/121 |
| 2069467 | 8/1981 | United Kingdom | 271/9.13 |
| WO9522462 | 8/1995 | WIPO . | |

*Primary Examiner*—H. Grant Skaggs

*Attorney, Agent, or Firm*—Sughrue, Mion, Zinn, Macpeak & Seas, PLLC

[57] ABSTRACT

A document guiding device for an automatic document feeder for a folding and/or inserting machine, the feeder being of the type including a feeder body support plate extending over a sheet inlet chute, at least two loading trays capable of cooperating with said inlet chute in various modes of operation, at least one of the trays including a tilting base capped by a die, constituted by a lip covered in a rough coating and capable of occupying either a closed position for automatic insertion of documents, or an open position for manual insertion, the device including first deflector means disposed upstream from a document feed roller, cooperating selectively with the tilting base so as to orientate each inserted document directly towards the inlet chute to eliminate any points where the lower edge of the document might catch on the roller, or on the feeder body.

9 Claims, 7 Drawing Sheets

FIG_7
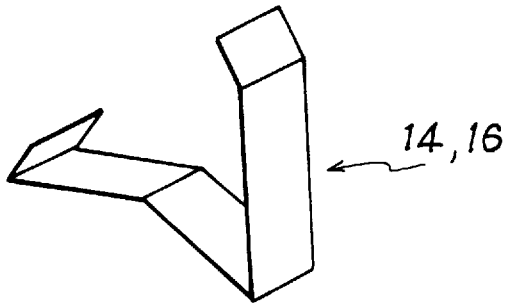
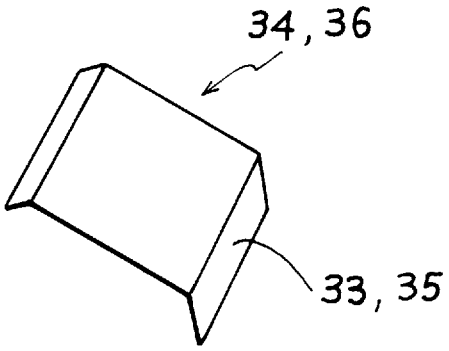
FIG_8

DOCUMENT GUIDING DEVICE FOR A FOLDING AND OR INSERTING MACHINE

FIELD OF THE INVENTION

The present invention relates to the specific field of mail processing. It relates in particular to a device for guiding various documents, such as sheets of mail, which device is designed to improve the multiple-tray, automatic document feeder for the folding and/or inserting machine described in European patent No. 0 661 175 filed by the Applicant.

PRIOR ART

Such office machines usually comprise a framework and a document feed device, an empty-envelope hopper, and a filled-envelope output device all mounted thereon. In each filled envelope at least one document, folded or otherwise, has been inserted.

The feeder previously developed by the Applicant makes that type of machine very flexible to use by means of a wide range of operating modes for various categories of document (size, weight, quality, type, . . . ). In addition, the use of a plurality of loading trays in automatic operating mode enables the throughput of the machine to be considerably increased.

However, it appears that certain documents having significant permanent curving and/or cutting faults cause the machine to function wrongly, particularly while such documents are being inserted and engaged, and regardless of the weight and type of paper used, this fault being particularly noticeable when documents coming from a laser printer are being inserted automatically.

OBJECT AND BRIEF SUMMARY OF THE INVENTION

The invention thus seeks to solve the problem caused by inserting documents having a pronounced curving into a feeder having multiple trays, or even a single tray, both in automatic mode and in manual mode.

The invention thus provides a document guiding device for an automatic document feeder for a folding and/or inserting machine, the feeder being of the type including a feeder body support plate extending over a sheet inlet chute, at least two loading trays capable of cooperating with said inlet chute in various modes of operation, at least one of the trays including a tilting base capped by a die, constituted by a lip covered in a rough coating and capable of occupying either a closed position for automatic insertion of documents, or an open position for manual insertion, the device including first deflector means disposed upstream from a document feed roller, cooperating selectively with the tilting base so as to orientate each inserted document directly towards the inlet chute to eliminate any points where the lower edge of the document might catch on the roller, or on the feeder body.

This configuration, advantageous both in manual loading mode and in automatic loading mode, effectively straightens documents having a pronounced permanent curving by steering them directly towards the sheet inlet. In addition, the device does not exert its effects to the detriment of the operation and capacity of the folding and inserting machine.

The first deflector means include a positioning deflector fixed under a priming deflector secured to the support plate and having a front face inclined towards a pressure plate at a determined acute angle, sufficient to allow the documents to slide towards the sheet inlet chute. The front priming deflector is preferably of length equal to about two thirds of the width of the documents, and the positioning deflector is formed by at least one thin, narrow, flexible blade, presenting a Z-shaped longitudinal cross-section ensuring that it is highly flexible. Advantageously, the blade is made of spring material enabling the document(s) to flatten perfectly against the pressure plate.

In a preferred second embodiment enabling the documents to be fed in an automatic loading mode, the document guiding device further includes second deflector means fixed on an upper portion of the tilting base and facing the document feed roller so as to orientate each inserted document directly towards the inlet chute to eliminate any points where the lower edge of the document might catch on the base.

By using these additional means, documents having pronounced permanent curving, whose lower or upstream edges may present ragged cuts, for example, are directed accurately towards the document selection mechanism by limiting contact between the document and the base of the feeder.

The second deflector means include front sliding ribs between which insertion tabs are fixed, each of the tabs being extended by a front face which descends to the level of the rough coating covering the lip of the tilting base. The front face of the insertion tab, which preferably has a low friction coefficient, is inclined relative to the pressure plate by a predetermined angle lower than the angle of inclination of the ribs relative to said same plate.

The present invention also relates to any automatic document feeder for a folding and/or inserting machine including a document guiding device as described above.

BRIEF DESCRIPTION OF THE DRAWINGS

Other characteristics and advantages of the present invention appear further from the following description given by way of non-limiting indication and with reference to the accompanying drawings, in which:

FIGS. 7 and 8 are two perspective views of various elements constituting the guiding device of the invention.

DETAILED DESCRIPTION OF A PREFERRED EMBODIMENT

Figure 1:
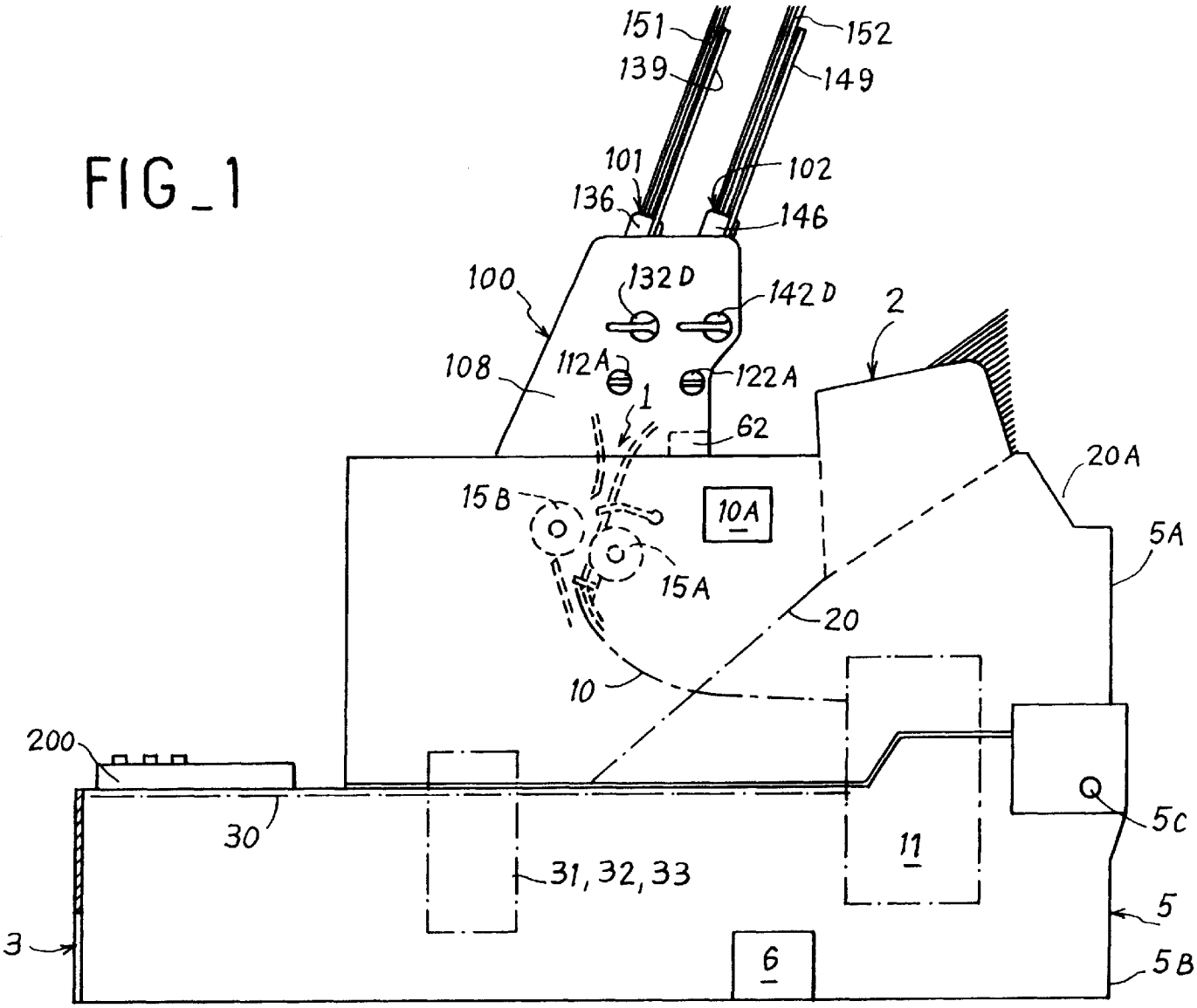
FIG. 1 is a diagrammatic view of a folder/inserter fitted with a automatic document feeder.

In FIG. 1, the folding and inserting machine of the invention ensures that documents such as sheets of mail are put into envelopes, preferably as the sheets are being prepared. The machine is part of the equipment of a workstation or it constitutes one of the machines at the disposition of the person working at said station. The machine of the invention is merely placed on the work surface of the station, from where it can be accessed easily by the person at said station, in particular for presenting sheets which it puts into envelopes.

The machine presents a sheet inlet 1 situated at the base of a feeder 100, an empty-envelope hopper 2, and a filled- and sealed-envelope outlet 3, which are set-up on a machine framework 5. The framework 5 is formed in two portions, an "upper framework" 5A and a "lower framework" 5B. The upper framework has an open bottom face and is hinge-mounted about a shaft 5C to the lower framework which has an open top face. The shaft 5C is housed in the lower framework close to its rear wall, where "rear" is assuming the machine is in position in a workstation. In addition, the upper framework 5A is locked onto the lower framework 5B by known releasable means (not shown) thereby closing it.

The sheet inlet 1 and the empty-envelope hopper 2 are defined on the upper wall of the upper framework 5A, with the inlet 1 being further forward than the empty envelope hopper 2. The filled- and sealed-envelope outlet 3 for sealed and filled envelopes is defined at the bottom, front of the lower framework 5B. The prepared sheets of mail are thus easily inserted into the inlet 1, while the sealed envelopes are easily taken from the outlet 3; packets of empty envelopes are loaded into the hopper 2 which constitutes the empty-envelope inlet and avoids each empty envelope having to be inserted manually into said inlet.

The sheet inlet 1 is linked to a sheet path 10 inside the machine, which feeds a folding module 11. The folding module 11 preferably has two folding pockets associated with a set of folding rollers. The path 10 defines the route for sheets transferred from the inlet 1 to the folding module 11. The path forms a bend guiding the sheets from the inlet 1 to the rear portion of the upper framework 5A in order to feed the folding module which is mounted partly in the rear portion of the framework 5A and partly in the rear portion of the framework 5B. At the end of the path 10, the folding module itself folds back the sheets it is folding.

The empty-envelope hopper 2 constituting the empty-envelope inlet is linked to an empty-envelope path 20 inside the machine. The path 20 intersects the sheet path 10, ending up substantially in the middle of the machine. The path 20 is fitted with opening means for opening the flaps of the empty envelopes.

The sealed envelope outlet 3 is linked to a filled-envelope path 30. The path 30 is substantially linear; it extends above the outlet 3, between the upper and lower frameworks 5A, 5B, from the front portion of the machine to the empty-envelope path 20, and it is substantially aligned with the sheet outlet of the folding module 11. The path 30 is fitted with a filling module 31 for filling the empty envelopes with sheets; a moistening module 32 for moistening the flaps; and a folding and sealing module 33 for folding and sealing the flaps.

The folding, filling, and moistening modules 11, 31, 32, are said to be "functional" modules because they are structurally split up when the upper framework 5A is opened relative to the lower framework 5B.

A control circuit 6 controls the machine during a control cycle, in co-operation with an interface circuit 62 belonging to the feeder 100.

Figure 2:
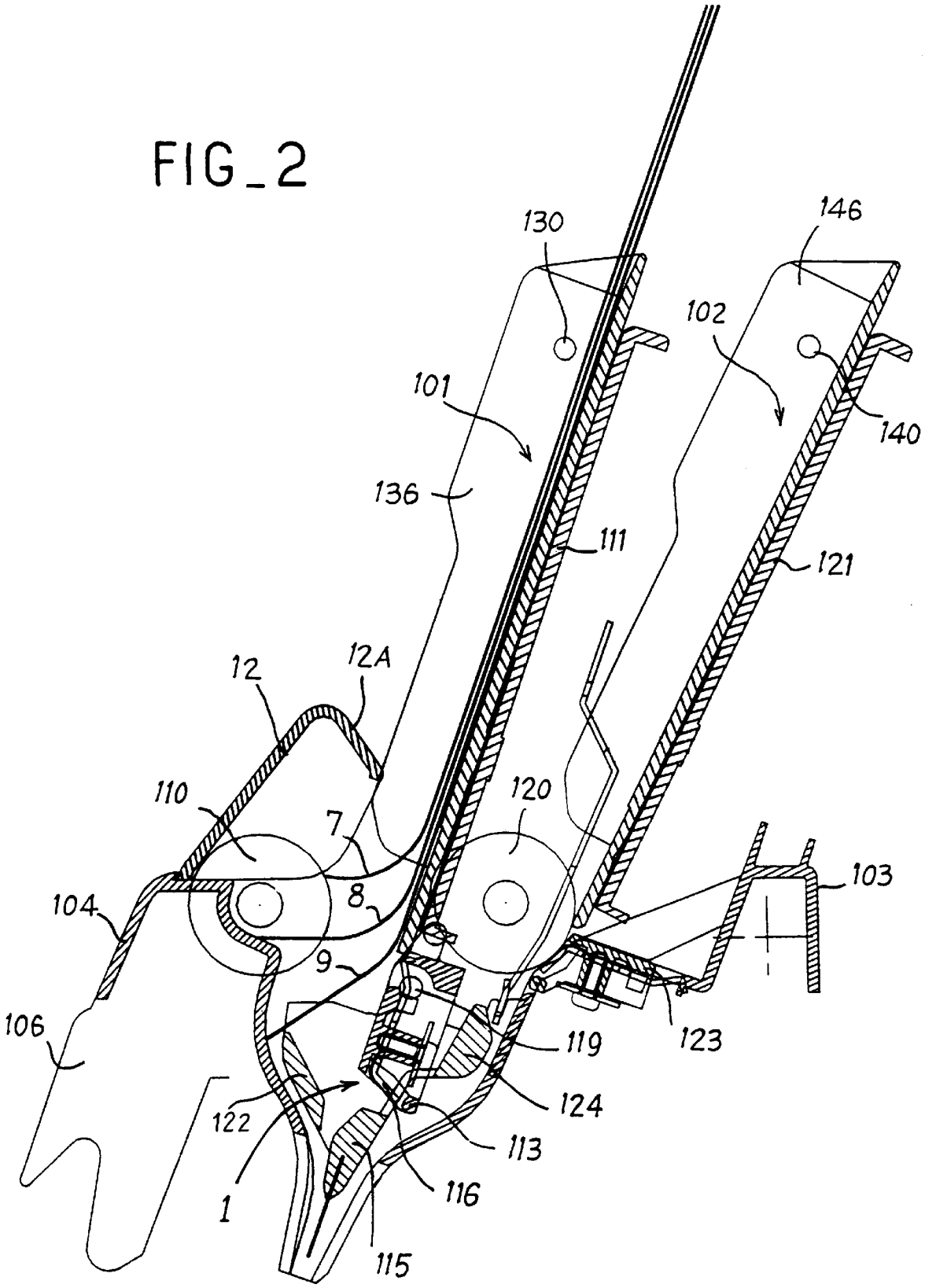
FIG. 2 is a diagrammatic cross-section view of the prior art feeder as shown in FIG. 1.

The folding module 11, the sheet path 10, the inlet 2 for the empty envelopes and their path 20, the filled envelope path 30 with the moistening and sealing modules 32, 33, and the control circuit 6, are all described in detailed manner in patent EP 0 352 692 which relates to a folding and/or inserting machine on which the feeder, now described with reference to FIG. 2, can be mounted.

The document feeder includes loading trays 101, 102 formed inside a feeder body 103. The feeder body includes a support plate 104 flanked by two side plates 106 covered by two covers 108. The body is fitted and locked on the upper wall of the upper framework 5A by means of two front fixing tabs and two side locking tongues having flexible blades (not shown).

The first loading tray 101, which is a convertible tray capable of occupying either a closed position for automatic insertion of documents, or an open position for manual insertion, is essentially constituted by:

- a tilting base 113 capped by a die 114, constituted by a lip 116 itself covered in a rough separation coating 118, and hinged about a pivot axis 119 fixed to the side plates 106 (FIG. 5);
- a perforated pressure plate 111 hinged to the side plates 106 by two pivot pins 130 against a return spring (not shown);
- two margin arch 136 sliding simultaneously by means of a rack (not shown) over the pressure plate 111;
- a support bow 139 for holding the documents in an inclined position immediately in line with the margin stops; and
- at least one feed roller 110 for feeding documents 151 (the documents 151 of FIG. 2 comprising three sheets 7, 8, 9), the roller 110 being driven by a drive motor 10A of the machine by means of a clutch (not shown).

In addition, the second loading tray 102 which, on the contrary, is a non-convertible tray, is essentially constituted by the following elements:

- a fixed base 123 which forms an integral part of the support plate 104, provided with a die and also constituted by a lip which is itself covered in a rough separation coating;
- a perforated pressure plate 121 hinged to the side plates 106 by two pivot pins 140 against a return spring (not shown);
- two margin stops 146 sliding simultaneously by means of a rack (not shown) over the pressure plate 121;
- a support arch 149 for holding the documents in an inclined position immediately in line with the margin stops; and
- at least one feed roller 120 for feeding documents 152, the roller being driven by the drive motor 10A of the machine by means of a clutch (not shown).

The support plate 104 of the feeder body 103 is extended in its lower portion by the inlet chute 1 for the documents coming from the loading trays 101, 102. Upstream from a drive wheel 15A and a backing-wheel 15B (see FIG. 1), the inlet chute contains two deflectors 122, 124 and a separator 115. Naturally, if so required, the feeder is also provided with detectors for detecting the presence of documents; passing-document detectors; and detectors for detecting multiple documents. The base of the first loading tray 101 is tilted and the pressure plate 111 is simultaneously disengaged under the control of a cam mechanism (not shown).

The first loading tray 101 further includes a front first deflector 12 for "priming" which is fixed on the support plate 104 of the feeder body 103. The front deflector is of length equal to about two thirds the width of the documents and it has an active face 12A inclined towards the pressure plate 111 at a predetermined acute angle, sufficient to allow the documents to slide towards the sheet inlet 1 situated at the base of the feeder 100.

The feeder 100 described above provides various operating modes, as follows:

- a first automatic loading mode with documents disposed in tray 101 or in tray 102 being fed automatically one by one;

a second automatic loading mode with documents composed of two sheets being fed automatically from respective trays 101, 102;

a combined loading mode with a document being fed automatically from the first tray 101, accompanied by a document being fed automatically from the second tray 102; and an entirely manual loading mode with a document being fed manually from the first tray 101.

The operating mode is selected using a control panel 200, which can be simply organized by means of push-buttons and a display.

Figure 3:
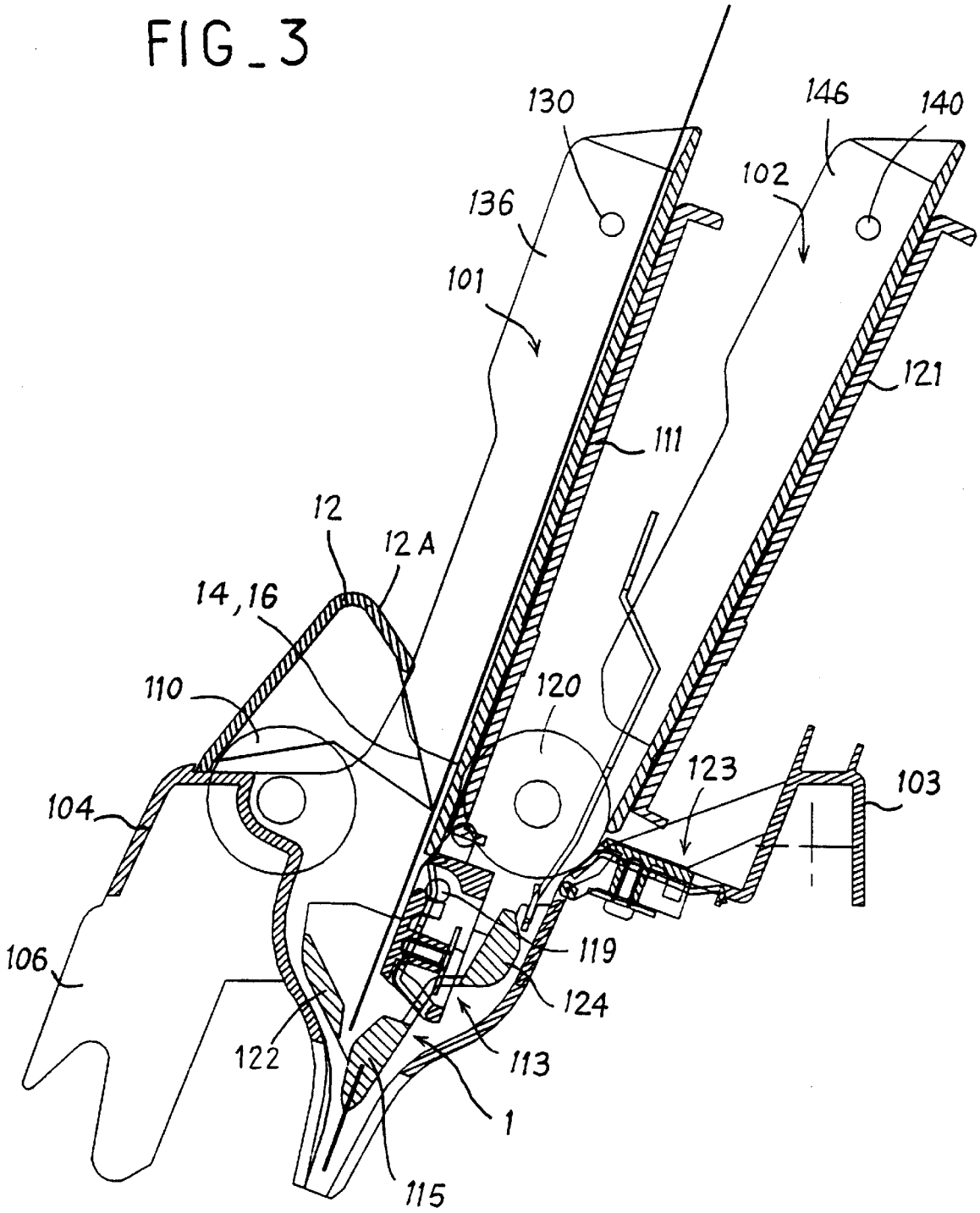
FIG. 3 is a diagrammatic cross-section view of a feeder provided with a document guiding device of the invention in manual loading mode.

FIG. 3 shows the feeder provided with a document guiding device of the invention. As can be seen in FIG. 2, sheets of mail having relatively pronounced permanent curve can come into abutment either with the document feed roller 110 (as in the case of sheet 7), or with internal portions of the support plate 104 (as in the case of sheet 8), or even with the deflector 122 of the inlet chute (as in the case of sheet 9), before reaching the sheet inlet 1 proper at the base of the feeder 100.

Figure 4:
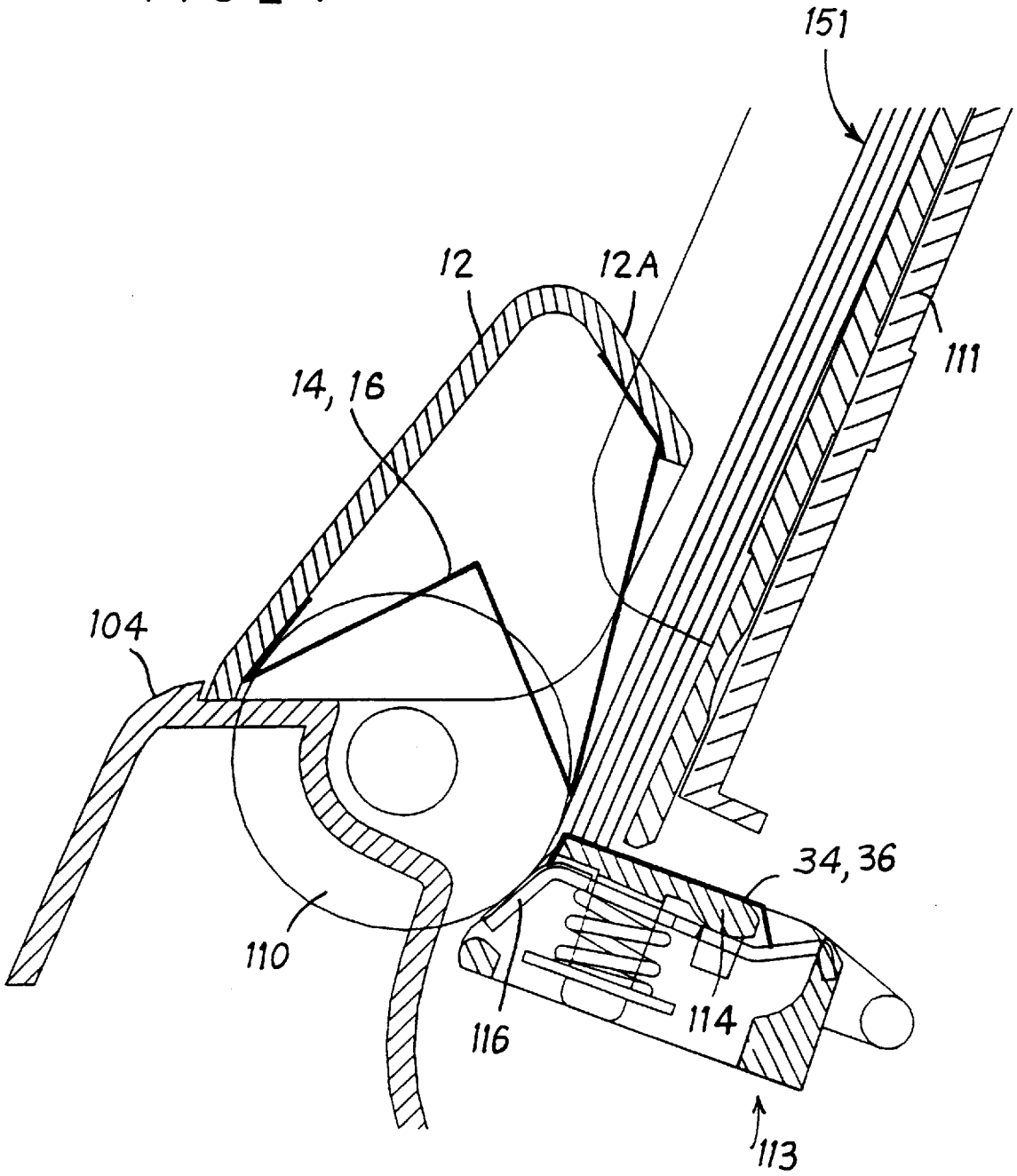
FIG. 4 is a diagrammatic fragmentary cross-section view of a feeder provided with a document guiding device of the invention in automatic loading mode.

This is why the present invention proposes providing a first deflector means upstream from the document feed rollers 110 by attaching a second deflector to the framework for positioning purposes, the second deflector being fixed under the first deflector 12 and being formed by two thin, narrow flexible blades 14, 16 advantageously made of spring material, and presenting a Z-shaped longitudinal cross-section (a perspective view of such a blade is shown in FIG. 7). This specific cross-section allows the deflector to be very flexible, the deflector being able to adapt equally well to the manual loading mode as to the automatic loading mode in which the tilting base 113 is in a closed position and the pressure plate 111 receives a pile of documents 151 (shown in FIG. 4), and for which the deflector thus presents a more folded position.

Figure 5:
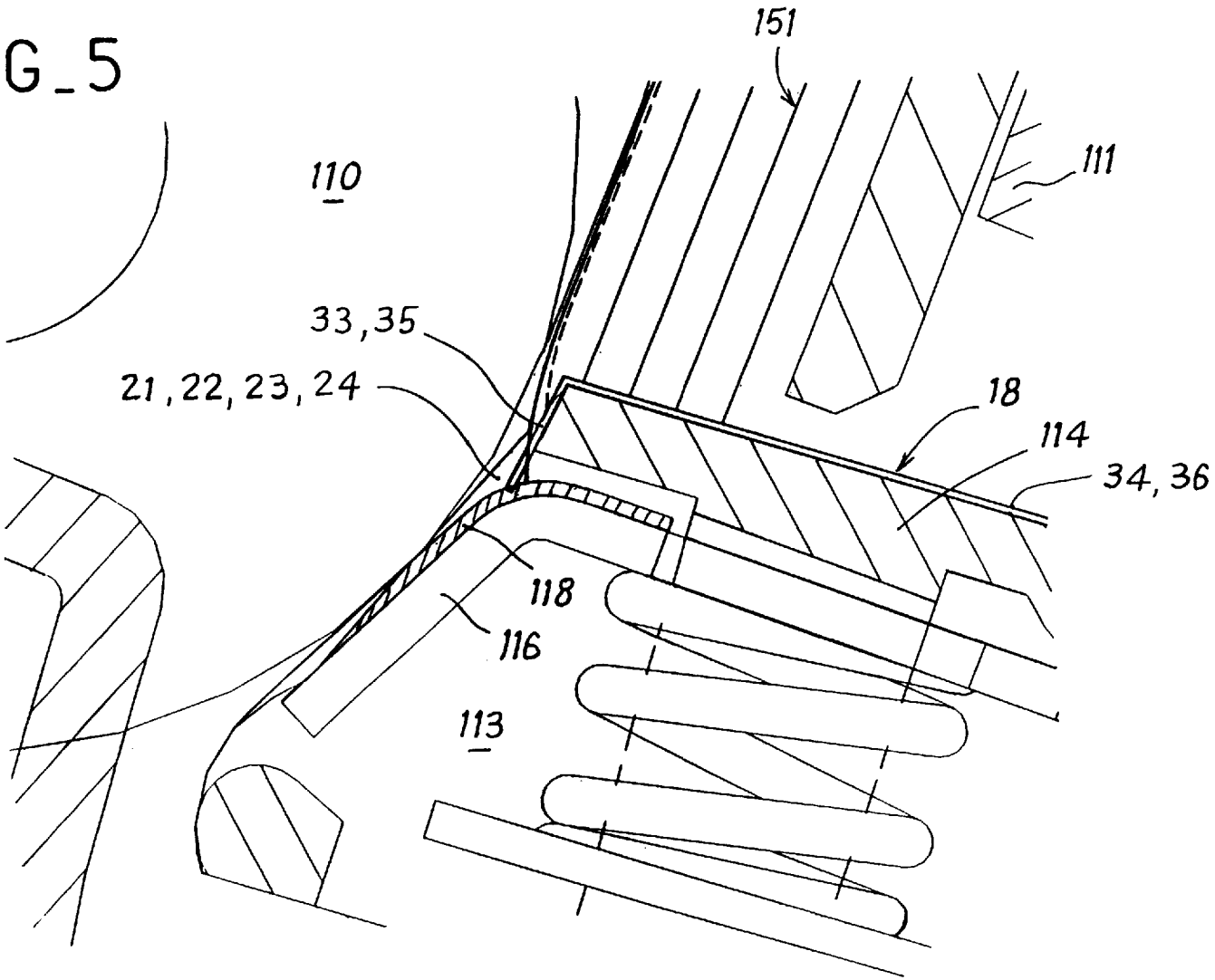
FIG. 5 is an enlarged diagrammatic cross-section view showing only the base of the feeder.

In this latter mode of operation, as shown in FIG. 5, the sheets of mail having a relatively pronounced curve can, despite everything, remain in abutment against the tilting base 113, in particular against its die 114 or its lip 116, as shown by the two dashed lines which represent two of the sheets. Thus second deflector means are proposed, constituted by extending an upper portion 18 of the tilting base 113 by sliding ribs 21, 22, 23, 24 extending forwards towards the document feed roller 110, substantially on either side of the roller, and by attaching to the tilting base 113 an insertion tab 34, 36 fixed to the upper portion 18 between two sliding ribs surrounding a predetermined roller (and thus level with the roller). Each of the tabs is extended by a front face 33, 35 which descends to the level of the rough coating 118 covering the lip 116 of the tilting base 113. The front faces which preferably have a low coefficient of friction are inclined relative to the pressure plate 111 at a predetermined angle smaller than the angle of inclination of the ribs relative to said plate (a perspective view of such a tab is shown in FIG. 8).

Figure 6:
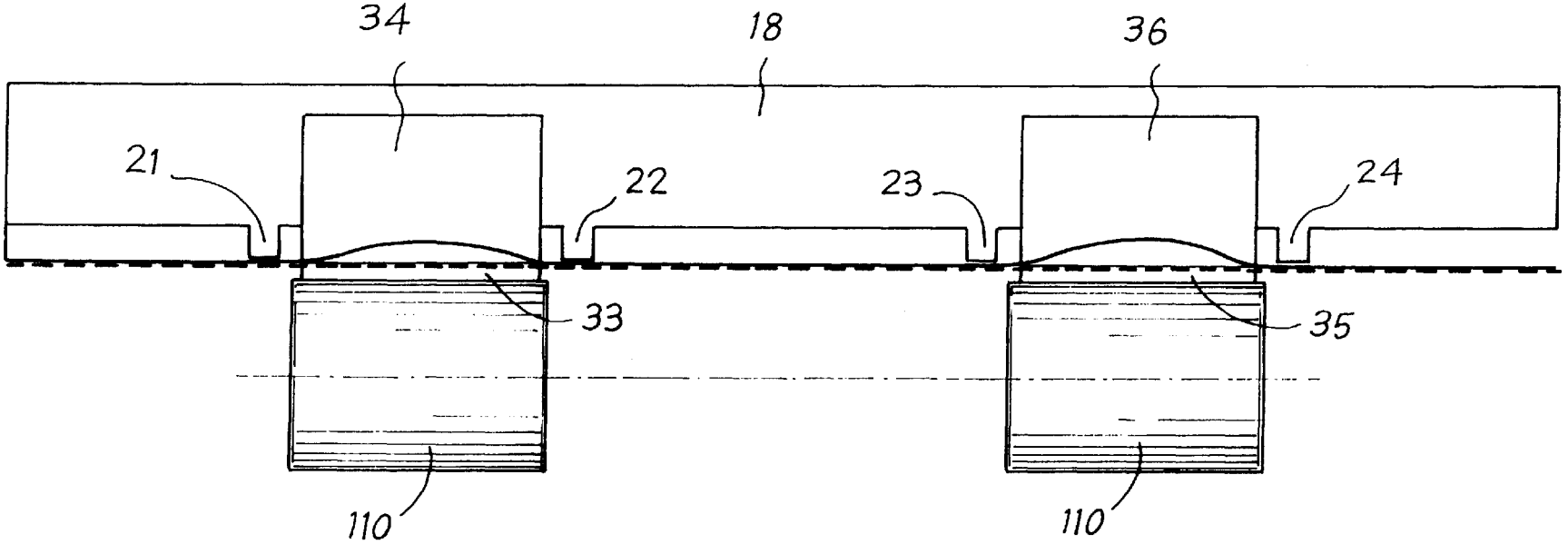
FIG. 6 is a plan view corresponding to FIG. 5.

The advantage of such a configuration is described mainly with reference to FIG. 6. As can be seen, the document which presents a pronounced permanent curve (shown by a solid line in the figure) has a tendency under the action of the rollers 110 to become wave-shaped which impedes good operation of the feeder. However, because of the structure of the invention, the document slides over the front faces 33, 35 of the tabs and the document is driven directly over the rough coating 118 upstream from the roller engagement zone, where the document can thus be selected without any difficulty. The document in direct contact with the rough coating is braked; enabling the document immediately above it to be selected.

The guiding device of the invention with the various above-defined deflector elements, tends to reduce the space which the documents can occupy in the loading trays of a folding and inserting machine. The volume in which the documents can maneuver thus comes closer to the ideal funnel-shape which leads as directly as possible to the sheet inlet.

We claim:

1. A document guiding device for an automatic document feeder for a folding and/or inserting machine, the feeder being of the type including a support plate of a feeder body, the support plate extending over a sheet inlet chute, at least two loading trays capable of cooperating with said inlet chute in various modes of operation, at least one of the trays including a tilting base capped by a die, constituted by a lip covered in a rough coating and capable of occupying either a closed position for automatic insertion of documents, or an open position for manual insertion, the device including first deflector means disposed upstream from a document feed roller, cooperating selectively with the tilting base so as to orientate each inserted document directly towards the inlet chute to eliminate any points where the lower edge of the document might catch on the roller, or on the feeder body.

2. A document guiding device according to claim 1, wherein the first deflector means include a positioning deflector fixed under a priming deflector secured to the support plate and having a front face inclined towards a pressure plate at a determined acute angle, sufficient to allow the documents to slide towards the sheet inlet chute.

3. A document guiding device according to claim 2, wherein the front priming deflector is of length equal to about two thirds of the width of the documents.

4. A document guiding device according to claim 2, wherein the positioning deflector is formed by at least one thin, narrow, flexible blade, presenting a Z-shaped longitudinal cross-section ensuring that it is highly flexible.

5. A document guiding device according to claim 4, wherein said blade is made of spring material.

6. A document guiding device according to claim 1, further including second deflector means fixed on an upper portion of the tilting base and facing the document feed roller so as to orientate each inserted document directly towards the inlet chute to eliminate any points where the lower edge of the document might catch on the base.

7. A document guiding device according to claim 6, wherein the second deflector means includes front sliding ribs between which insertion tabs are fixed, each of the tabs being extended by a front face which descends to the level of the rough coating covering the lip of the tilting base.

8. A document guiding device according to claim 7, wherein the front face of the insertion tab, which preferably has a low friction coefficient, is inclined relative to a pressure plate by a predetermined angle lower than the angle of inclination of the ribs relative to said same plate.

9. An automatic document feeder for a folding and/or inserting machine including a document guiding device according to claim 1.

* * * * *